US006923125B2

(12) United States Patent
Pieper et al.

(10) Patent No.: US 6,923,125 B2
(45) Date of Patent: Aug. 2, 2005

(54) RAILED VEHICLE WITH BODIES AND AT LEAST ONE CHASSIS

(75) Inventors: Reinard Pieper, Kirchhundem (DE); Guido Bieker, Kirchhundem (DE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 10/220,420

(22) PCT Filed: Feb. 28, 2001

(86) PCT No.: PCT/EP01/02219

§ 371 (c)(1),
(2), (4) Date: Jan. 21, 2003

(87) PCT Pub. No.: WO01/64493

PCT Pub. Date: Sep. 7, 2001

(65) Prior Publication Data

US 2003/0221581 A1 Dec. 4, 2003

(30) Foreign Application Priority Data

Mar. 3, 2000 (DE) ..... 100 10 610

(51) Int. Cl.[7] ..... B61F 1/00
(52) U.S. Cl. ..... 105/453
(58) Field of Search ..... 105/157.1, 164, 105/167, 171, 174, 175.1, 177, 179, 182.1, 185, 453

(56) References Cited

U.S. PATENT DOCUMENTS 4,294,175 A * 10/1981 Harsy ..... 105/199.3
4,457,238 A * 7/1984 Sobolewski ..... 105/168
4,625,652 A * 12/1986 Losa et al. ..... 105/4.1
6,244,577 B1 * 6/2001 Bucholtz ..... 267/136

FOREIGN PATENT DOCUMENTS

| | | |
|---|---|---|
| DE | 731139 | 12/1942 |
| DE | 2103100 A | 8/1972 |
| DE | 3324574 A | 1/1984 |
| DE | 3914790 A | 11/1990 |
| DE | 4422579 C | 4/1995 |
| DE | 4343608 C | 7/1995 |
| DE | 19532833 C | 1/1997 |
| EP | 0417594 A | 3/1991 |
| EP | 0548044 A | 6/1993 |

* cited by examiner

*Primary Examiner*—S. Joseph Morano
*Assistant Examiner*—Robert J. McCarry, Jr.
(74) *Attorney, Agent, or Firm*—Howrey, LLP

(57) ABSTRACT

A railed vehicle with bodies and at least one chassis is disclosed, rotatably mounted about a vertical axis, whereby rotating coupling elements are provided between chassis and body. At least two tie rods (6, 7, 6', 7', 27, 28, 29) with predetermined spring rate and damping are arranged as torque coupling elements between chassis (1, 26) and body, with a predetermined separation in the transverse direction of the chassis. The tie rods (6, 7, 6', 7', 27, 28, 29) are each flexibly connected to brackets (9) on the body, at one end and to a transverse support (2) of the chassis frame, at the other end. A tie rod (6, 7, 6', 7', 27, 28) comprises a universal housing, with a shell (12) and end head pieces (13, 14), which guides a push-/pull-rod (11), whereby, within said universal housing at least one friction ring set is mounted and which can be operated by a push-/pull-segment (18) of the push-/pull-rod (11).

21 Claims, 3 Drawing Sheets

6. 7

RAILED VEHICLE WITH BODIES AND AT LEAST ONE CHASSIS

The invention relates to a rail vehicle with a car body and at least one bogie which is mounted for rotating about a vertical axis of rotation.

Multi-unit rail vehicles, such as trams for example, have high wheel set guiding forces of the leading wheel owing to the rotary coupling of the bogie to the car body about the vertical axis of rotation and as a result of the arrangement of the unit elements of the car body in conjunction with the length of the car overhang of the head assembly and end assembly. These wheel set guiding forces increase as the travel speed increases and the length of the overhang arc decreases. The wheel set guiding forces can be reduced by elastically adjusting the rotational rigidity between the bogie and the car body. The difficulty is to implement the necessary elasticity at the required force level and the high power density in the limited installation space available.

Generally known rubber metal components which are used as rotary coupling elements are not sufficiently durable given the required density.

The invention is based on the object of specifying an improved rotary coupling of the at least one bogie to the car body and a rotary coupling element suitable for this purpose, for a rail vehicle.

This object is achieved according to the invention by the use of rotary coupling elements provided between the bogie and car body to provide rotary stiffness and rotary damping.

The advantages which can be achieved with the invention consist, in particular, in the fact that the proposed rotary coupling element implements the necessary elasticity at the required high force level and with the high power density in the limited installation space available, and at the same time has a long service life. In addition to the effect of the spring stiffness, the dynamics of the vehicle are significantly improved by the relative movement damping which is achieved. Overall, this significant reduction in the wheel set guiding forces is obtained. The proposed friction rings of the coupling rods implement spring stiffness and damping in a single element. However, as an alternative to this, it is also possible to implement spring stiffness and damping in separate components (coupling rods). A further alternative to this is to embody the rotary coupling element as a hydraulic suspension and damping element.

The coupling rods which are proposed as rotary coupling elements additionally perform the function of transmitting the longitudinal forces arising from the acceleration and deceleration of the vehicle.

Advantageous embodiments of the invention are defined in the subclaims.

Further advantages of the proposed rotary coupling elements emerge from the following description.

The invention is explained in more detail below by means of the exemplary embodiments illustrated in the drawing, in which.

Figure 1:
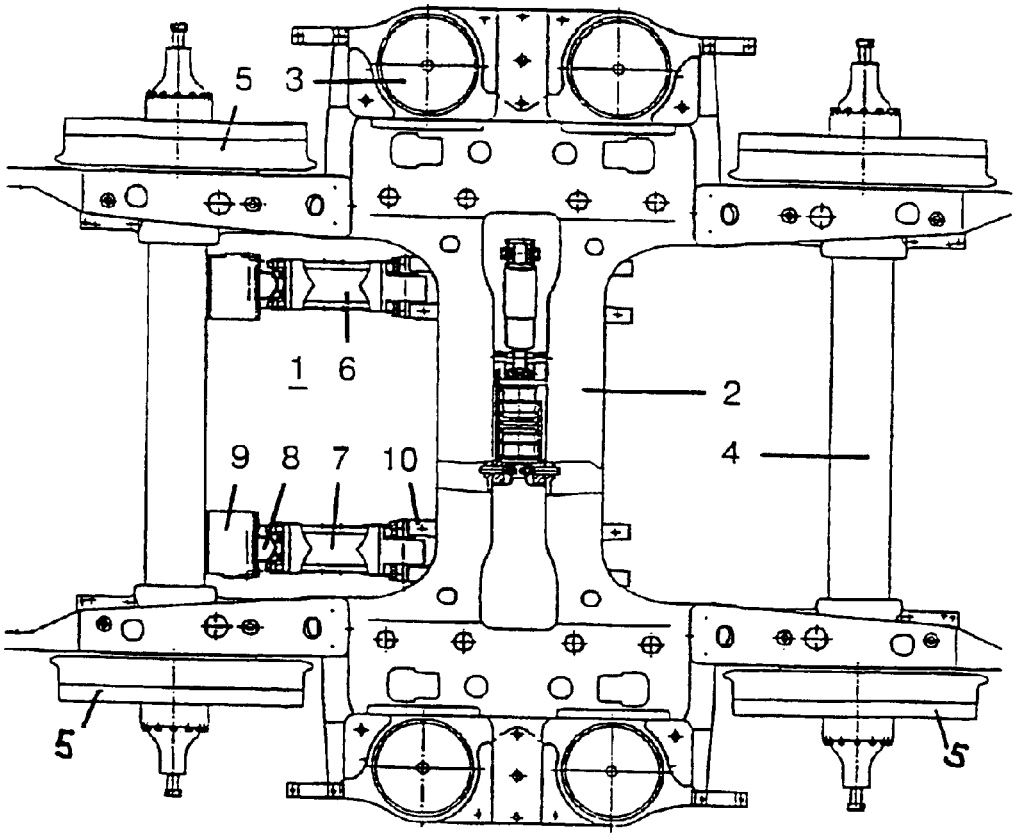
FIG. 1 shows a view of a bogie of a rail vehicle.

FIG. 1 is a view of a bogie of a rail vehicle. The bogie 1 has, as is generally known, a bogie frame, a transverse carrier of this bogie frame being designated by the numeral 2. Spring elements 3 of the bogie and the shafts 4 guided by the bogie with wheels 5 are shown.

According to the invention, two coupling rods 6, 7 with predefined spring stiffness and predefined damping are provided as rotary coupling elements between the bogie 1 and car body. They are arranged at a distance from one another viewed in the transverse direction of the vehicle. The articulated attachment of these coupling rods 6, 7 is effected by means of first mounting devices 8 on brackets 9 of the car body on the one hand and by means of second mounting devices 10 on the transverse carrier 2 of the bogie frame on the other.

Figure 2:
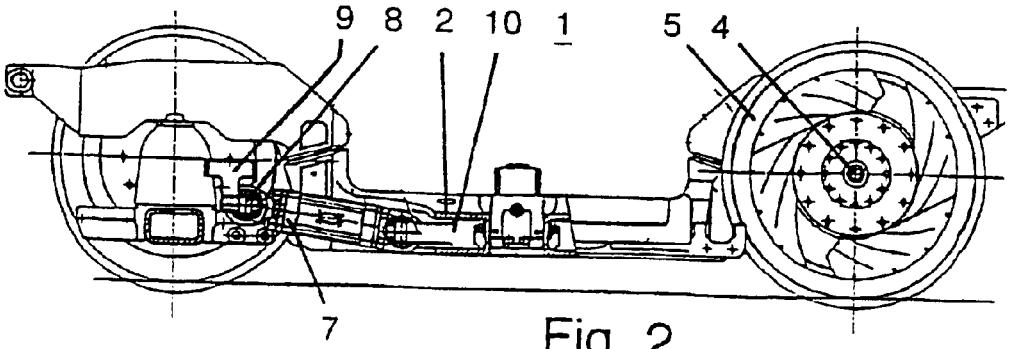
FIG. 2 shows a side view of a bogie of a rail vehicle according to FIG. 1 (partially sectional)

FIG. 2 is a side view of the bogie of the rail vehicle according to FIG. 1 (partially sectional). The transverse carrier 2 of the bogie frame or of the bogie 1 with the second mounting device 10, and a bracket 9 of the car body with the first mounting device 8 are shown, the coupling rod 6 or 7 being connected in an articulated fashion to both mounting devices 8, 10. The shafts 4 with wheels 5 are also shown.

Figure 3:
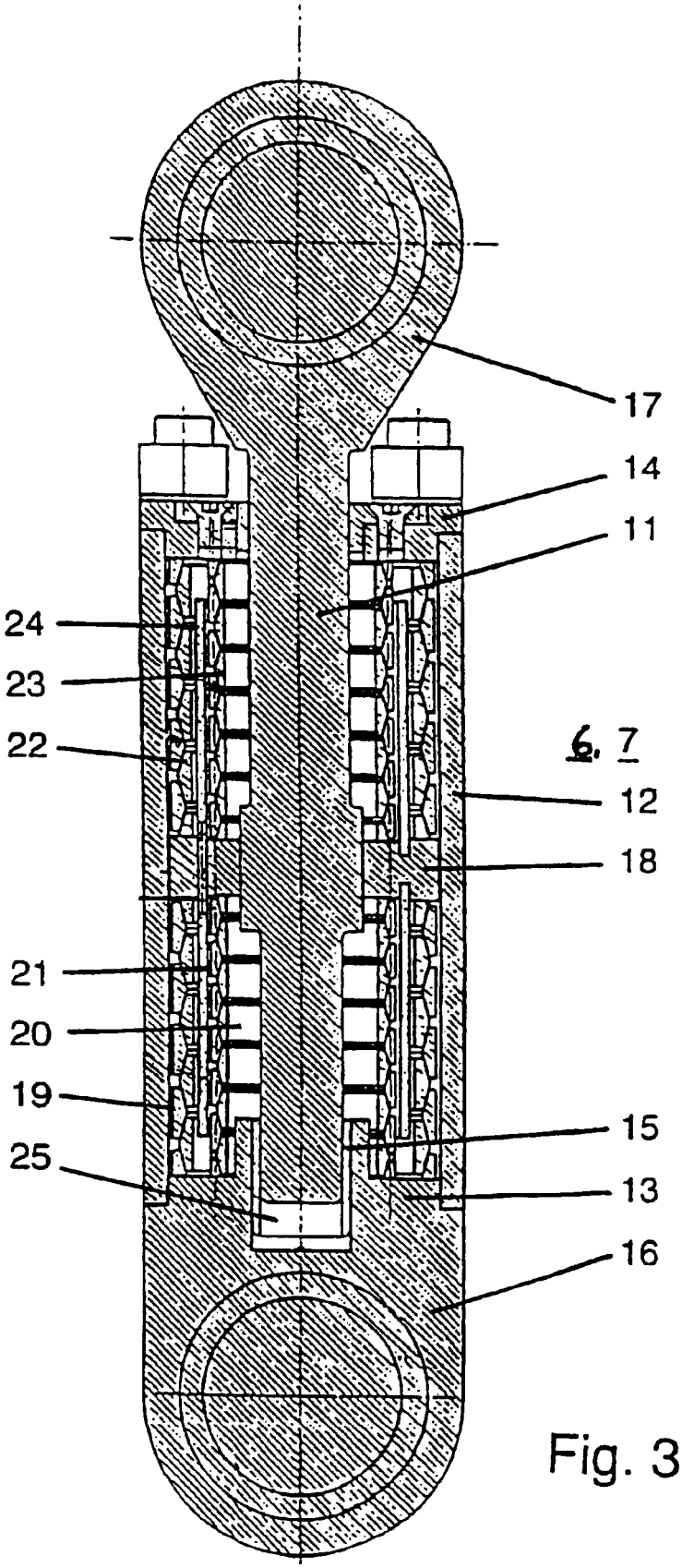
FIG. 3 shows a longitudinal section through a coupling rod of a first embodiment.

FIG. 3 shows a section through a coupling rod 6, 7 of a first embodiment. The coupling rod 7 has a push/pull rod 11 which is guided in a universal casing. The universal casing is composed essentially of a sleeve 12 which is terminated at both ends by means of a first frame end 13 and a second frame end 14. The first frame end 13 has an integrated rod guiding means 15 into which the end of the push/pull rod 11 which is the inner one with respect to the casing engages. A movement space 25 in the first frame end 13 ensures the free translatory mobility of the push/pull rod 11. Furthermore, the first frame end 14 has a first attachment device 16 which is suitable for articulated engagement of the first mounting device 8 mentioned above.

The second frame end 14 has a drilled hole for guiding the push/pull rod 11. That end of the push/pull rod 11 which engages through this drilled hole has a second attachment device 17 which is suitable for articulated engagement of the second mounting device 10 mentioned above. The section of the push/pull rod 11 which is guided within the universal casing is provided in the center with a push/pull element 18 which has an outer diameter which is adapted to the inner diameter of the sleeve 12. The inner space of the universal casing is divided into two subspaces of approximately the same size by the push/pull element 18.

The first outer friction rings or a first outer friction ring set 19 and first inner friction rings or a first inner friction ring set 20 are arranged in the first subspace, the two first friction ring sets 19, 20 being arranged concentrically in the first subspace and being separated from one another by means of an intermediate sleeve 21. In the same way, second outer friction rings or a second outer friction ring set 22 and second inner friction rings or a second inner friction ring set 23 are arranged in the second subspace, the two second friction ring sets 22, 23 being arranged concentrically in the second subspace and being separated from one another by means of an intermediate sleeve 24.

If owing to the deflection of the bogie 1 or of the bogie frame 2, the coupling rod 6 or 7 is compressed as in FIG. 3, it makes the movement space 25 smaller. During this movement the outer friction rings 19 are widened by the inner friction rings 20 being pushed on by means of the push/pull element 18, as in the first part ring. The inner friction rings 20 run along the inclined contact faces and onto the outer friction rings 19, which leads to the aforementioned widening of the friction rings 19. As a result, the kinetic energy is converted into thermal energy in the desired way by friction. During this movement of the push/pull rod into the movement space 25, the friction rings 22, 23 of the second subspace remain unaffected.

If, on the other hand, the push/pull rod 11 according to the drawing is moved upward, the movement space 25 being made larger, the same effect occurs at the friction rings or friction ring sets 22, 23 in the second subspace as when the rod 11 moves down in the case of the rings 19, 20 in the first subspace. The energy conversion from kinetic energy into thermal energy thus takes place in the second subspace. The friction rings 19 and 20 of the first subspace are not involved here either.

As already mentioned above, the proposed solution preferably provides that, in addition to the spring stiffness, damping parallel to the spring stiffness has a positive influence on the reduction of the wheel set guiding forces. Desired spring stiffness and desired damping are advantageously implemented by means of a single structural element, the friction rings or friction ring sets. This is a very space-saving and weight-saving solution. The friction rings supply the desired spring stiffness by virtue of their elastic widening, and the desired damping as a result of the pushing on associated with friction.

The embodiment shown in FIG. 3 corresponds here to a variant in which two concentrically arranged friction ring sets are used. With this variant the spring force of the coupling rod and respectively of the rotary coupling element connected to it can be increased in a desired fashion. On the other hand, the desired spring travel can be defined by selecting the number of friction rings. Further variants with, in each case, just one friction ring set in both directions of movement (spring directions) or with more than two concentrically arranged friction ring sets in both directions of movement can be implemented in the same way. Further variants are obtained by not providing a complete set of friction elements for each spring direction but alternatively using dual-action friction rings.

Overall, the desired spring characteristic curve can thus be set in a variable way in a universal casing by selecting the type and number of friction rings, it being possible to act on the available installation space in a variable fashion in each case by the arrangement of the friction rings (concentric or non-concentric, with a single action or dual action). This variability which is achieved is very useful because different spring characteristic curves which are appropriately adjusted for different vehicles are necessary owing to changes in the geometry and the mass distribution of the vehicle. For example, a spring characteristic curve may be required in which the final force is increased with a greater spring travel. On the other hand, for a different application case it may be necessary for the final force to be reduced with a longer spring travel. All the combinations of spring travel in relation to final force can thus be implemented, i.e. the invention permits these different requirements which are specific for respective application cases to be met in a cost-saving way.

To prestress the friction rings it is possible to use slotted friction rings or an additional helical spring. The slotted friction rings are friction rings which are not closed in the circumferential direction but are rather slotted. The helical spring would be arranged centrically on both sides around the push/pull rod 11 in the space between the push/pull rod 11 and the inner friction rings (friction ring set 23) in the axial direction.

Figure 4:
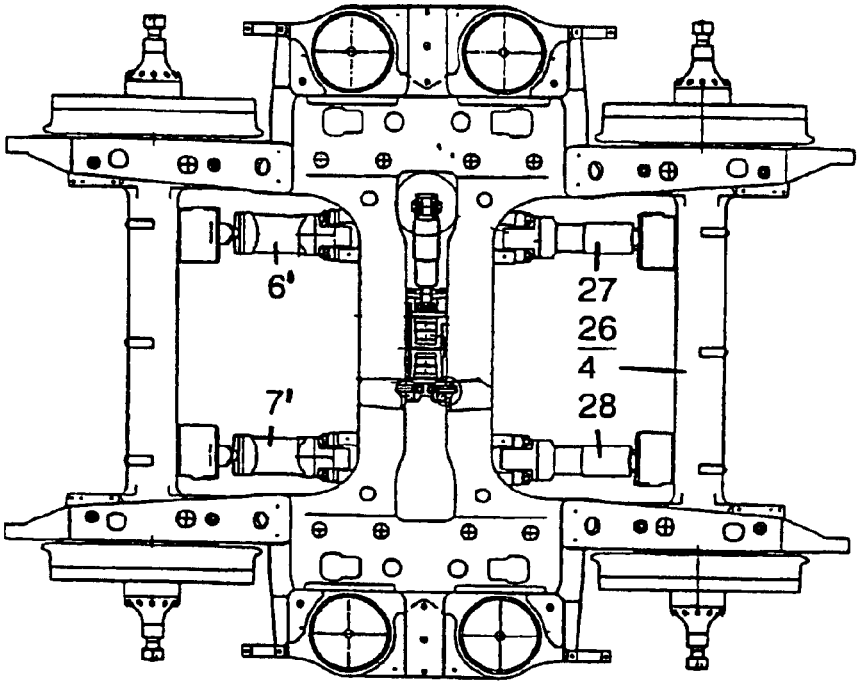
FIG. 4 shows a view of a bogie of a rail vehicle which is an alternative embodiment to the subject matter of FIG. 1.

FIG. 4 shows a plan view of a rail vehicle with an alternative design. In contrast to the bogie 1 according to FIGS. 1 and 2, in the bogie 26 coupling rods 6', 7', 27 and 28 are in turn arranged spaced apart with respect to the transverse direction of the vehicle as rotary coupling elements between the bogie 26 and car body. The coupling rods 6' and 7' are conventional dampers here with which the aimed-for damping is achieved. The desired spring stiffness is implemented by means of known spring elements 27, 28 such as helical springs, plate springs or the like. These coupling rods 6', 7', 27, 28 are in turn coupled to brackets of the car body by means of the first mounting devices on the one hand and to the transverse carrier of the vehicle frame by means of second mounting devices on the other.

Figure 5:
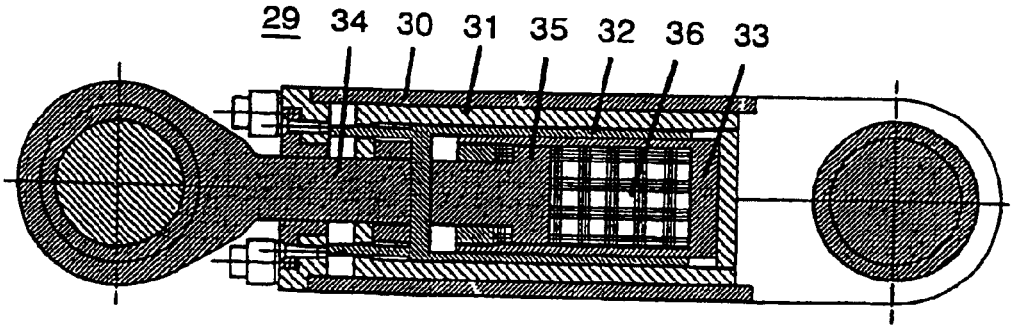
FIG. 5 shows a longitudinal section through a coupling rod of a second embodiment.

FIG. 5 illustrates a section through a coupling rod of a second embodiment. This coupling rod 29, which can be used instead of the coupling rod 6, 7 with their friction rings, is hydraulically active and has an outer casing 30, a pull casing 31, a push casing 32, a fluid casing 33 and a push/pull rod 34 with piston 35. The inner space which is bounded by the fluid casing 33 and piston base is filled with fluid 36 which can be compressed within certain limits. A low-viscosity silicone or a high-viscosity rubber may be used as the fluid 36. The articulated attachment devices on the push/pull rod and casing, which attachment devices are suitable for mounting on the bogie and car body, are embodied as in FIG. 3. This coupling rod thus in turn implements damping and spring stiffness in a single structural element.

| | |
|---|---|
| 1 | Bogie |
| 2 | Transverse carrier of the bogie frame |
| 3 | Spring element |
| 4 | Shaft |
| 5 | Wheel |
| 6 | Coupling rod |
| 7 | Coupling rod |
| 8 | First mounting device |
| 9 | Bracket of car body |
| 10 | Second mounting device |
| 11 | Push/pull rod |
| 12 | Sleeve |
| 13 | First frame end |
| 14 | Second frame end |
| 15 | Rod guiding means |
| 16 | First attachment device |
| 17 | Second attachment device |
| 18 | Push/pull element |
| 19 | First outer friction ring set |
| 20 | First inner friction ring set |
| 21 | Intermediate sleeve |
| 22 | Second outer friction ring set |
| 23 | Second inner friction ring set |
| 24 | Intermediate sleeve |
| 25 | Movement space |
| 26 | Bogie |
| 27 | Coupling rod (spring element) |
| 28 | Coupling rod (spring element) |
| 29 | Hydraulically acting coupling rod |
| 30 | Outer casing |
| 31 | Pull casing |
| 32 | Push casing |
| 33 | Fluid casing |
| 34 | Push/pull rod |
| 35 | Piston |
| 36 | Fluid |

What is claimed is:

1. A rail vehicle with a car body and at least one bogie which is mounted for rotating about a vertical axis of rotation, rotary coupling elements being provided between the bogie and car body, wherein the rotary coupling elements comprise at least two telescopic couplings which are arranged at a distance from one another in the transverse direction of the vehicle and which have a predefined spring stiffness and damping, each of the telescopic couplings having a first and second end spaced apart from one another in the longitudinal direction.

2. The rail vehicle as claimed in claim 1, wherein the predefined spring stiffness and the damping of the rotary coupling elements are implemented by means of separate components.

3. The rail vehicle as claimed in claim 1, wherein the telescopic couplings are attached, in each case in an articulated fashion, to brackets of the car body on the one hand and to a transverse carrier of the bogie frame on the other.

4. The rail vehicle as claimed in claim 1, wherein at least one of the telescopic couplings has a universal casing comprising a sleeve and frame ends at the ends, the universal casing guiding a push/pull rod, at least one friction ring set, which can be actuated by means of a push/pull element of the push/pull rod, being mounted within the universal casing.

5. The rail vehicle as claimed in claim 4, wherein at least one of the friction rings sets comprises a dual-action friction ring set.

6. The rail vehicle as claimed in claim 4, wherein at least one of the friction ring sets comprises at least two friction rings sets which are each single-action friction ring sets.

7. The rail vehicle as claimed in claim 5, wherein at least one of the friction ring sets comprises at least two concentrically arranged friction ring sets.

8. The rail vehicle as claimed in claim 4, wherein at least one of the friction ring sets comprises a helical spring for prestressing the friction rings.

9. The rail vehicle as claimed in claim 4, wherein at least one of the friction ring sets comprises slotted friction rings for prestressing the friction rings.

10. The rail vehicle as claimed in claim 1, wherein the telescopic couplings comprises hydraulically acting coupling rods.

11. The rail vehicle as claimed in claim 10, wherein the telescopic couplings include a fluid which can be compressed within certain limits and which is located in an interior space which is bounded by a fluid casing and a piston of a push/pull rod.

12. A rail vehicle with a car body and at least one bogie which is mounted for rotating about a vertical axis of rotation, comprising at least two coupling elements spaced apart in the transverse direction of the vehicle, a first end of the coupling elements having an articulated connection to the car body and a second end of the coupling elements having an articulated connection to the bogie, the coupling elements having a predefined spring stiffness and damping acting substantially in a longitudinal direction of the vehicle.

13. The rail vehicle as claimed in claim 12, wherein the first end of the coupling elements are attached to brackets connected to the car body and the second end of the coupling rods are attached to a transverse carrier of the bogie frame.

14. The rail vehicle as claimed in claim 12, wherein the coupling rods comprise a compressible structure wherein compression of the coupling elemtents is controlled by at least one friction ring set.

15. The rail vehicle as claimed in claim 12, wherein the coupling rods comprise a extendable telescopic structure wherein extension of the coupling elements is controlled by at least one fiction ring set.

16. The rail vehicle as claimed in claim 15, wherein at least one of the friction ring sets comprises at least two concentrically arranged friction ring sets.

17. The rail vehicle as claimed in claim 15, wherein at least one of the friction ring sets comprises a helical spring for prestressing the friction rings.

18. The rail vehicle as claimed in claim 15, wherein at least one of the friction ring sets comprises slotted friction rings for prestressing the friction rings.

19. The rail vehicle as claimed in claim 12, wherein the coupling elements comprise hydraulically acting coupling elements containing a fluid which can be compressed within certain limits.

20. The rail vehicle as claimed in claim 12, comprising wherein the predefined spring stiffness and the damping of the rotary coupling elements are implemented by means of separate components.

21. A rail vehicle with a car body and at least one bogie which is mounted for rotating about a vertical axis of rotation, rotary coupling elements being provided between the bogie and car body to provide rotary stiffness and rotary damping, wherein the rotary coupling elements comprise at least two telescopic couplings which:

extend in the longitudinal direction of the vehicle, are articulated to the vehicle body and to the bogie, are arranged at a distance from one another in the transverse direction of the vehicle, and have a predefined spring stifftncss and damping.

* * * * *